United States Patent [19]

Richards et al.

[11] Patent Number: 4,691,789

[45] Date of Patent: Sep. 8, 1987

[54] PROCESS FOR ESTABLISHING A CLEAR HORIZONTAL BOREHOLE IN A SUBTERRANEAN FORMATION

[75] Inventors: Walter L. Richards, Huntington Beach, Calif.; Roger L. Henderson, Bluefield, W. Va.; George N. Aul, Richlands, Va.; Barry W. Pauley, West Blocton, Ala.

[73] Assignee: Methane Drainage Ventures, Placentia, Calif.

[21] Appl. No.: 871,903

[22] Filed: Jun. 9, 1986

[51] Int. Cl.[4] ..... E21B 7/20; E21D 10/00

[52] U.S. Cl. ..... 175/62; 175/72; 175/171; 175/262; 405/146

[58] Field of Search ..... 175/22, 62, 65, 72, 175/257, 262, 171, 378, 380; 166/71, 381; 405/138, 140, 150, 146

[56] References Cited

U.S. PATENT DOCUMENTS

| | | | |
|---|---|---|---|
| 2,550,408 | 4/1951 | Fehlmann | 166/381 |
| 3,011,567 | 12/1961 | Turner | 175/72 |
| 3,318,396 | 5/1967 | Tailleur | 175/72 |
| 3,845,828 | 11/1974 | Taylor et al. | 175/62 |
| 3,958,648 | 5/1976 | Grönblad | 175/23 |
| 4,091,631 | 5/1978 | Cherrington | 175/62 |
| 4,595,059 | 6/1986 | Katagiri et al. | 175/171 |

*Primary Examiner*—Stephen J. Novosad
*Assistant Examiner*—Bruce M. Kisliuk
*Attorney, Agent, or Firm*—Walter A. Hackler

[57] ABSTRACT

A process for establishing a clear, generally horizontal borehole path in a subterranean formation includes drilling a generally horizontal borehole using a drill pipe, drill bit and an uphole drilling device and lubricating the drill bit and pipe by pumping a mud down the center of the drill pipe in sufficient quantity to carry cuttings, created by the drilling, from the horizontal borehole using a mud capable of creating a cake on the borehole wall. Throughout drilling of the borehole, the total solids content of the efflux is adjusted to preselected levels and recirculated through the drill pipe to continually create the borehole wall cake. After drilling, the drill bit and drill rod are removed and the drilling bit replaced with a casing shoe. Thereafter, the drill pipe is reinserted into the borehole with a liner therein. After inserting the liner to a preselected distance, the drill pipe and casing shoe are withdrawn from the borehole while holding the liner in the generally horizontal borehole to create a clear path therethrough.

16 Claims, 6 Drawing Figures

PROCESS FOR ESTABLISHING A CLEAR HORIZONTAL BOREHOLE IN A SUBTERRANEAN FORMATION

The present invention is directed to boring holes in underground formations and, more particularly, directed to a process for establishing clear, generally horizontal borehole paths in subterranean formations having sloughing or caving characteristics.

Most mining operations require ventilation of the workings in order to provide fresh air for the miners and to remove gases released during mining operations, which are either toxic and/or explosive.

Nowhere is this more important than in the mining of coal wherein methane flows into mine workings due to the pressure drop between the gas within the coal seam and the atmospheric pressure within the workings.

As coal is removed, the gas pressure in the virgin coal falls and the adsorption equilibrium is disturbed, thereby releasing some previously adsorbed gas into the microfactures of the coal and thereafter into the working area.

One long-relied upon method to remove such methane gas from the working area is by ventilation. Ventilation systems include the routing of fresh air through the working area and the maintaining of appropriate air flow in order to dilute methane present therein to acceptable levels. In addition, numerous ventilation holes may be drilled to accommodate such air flow and to provide additional air for circulation.

Typically, these ventilation holes are drilled through surrounding formations and very little drilling is in the coal seam itself. This is to be distinguished from the drilling of horizontal boreholes within a coal seam for the purpose of predraining methane gas therefrom, or for the collection of methane gas on a commercial basis. Significant differences exist between coal seam boreholes and boreholes outside the coal seam. For example, horizontal boreholes for the production of methane gas has as a primary objective, the release of methane gas from the coal structure itself, whereas ventilation holes drilled through surrounding formations are directed to providing a clear path for enabling the circulation of air through working areas.

The drilling of such ventilation holes to establish clear ventilation paths is in many cases difficult because of the sloughing or caving tendencies of the formations through which the holes are drilled. A similar situation exists when generally horizontal holes are to be drilled for the purpose of housing electrical cable or pipe in areas of weak structural integrity as may be the case, for example, under rivers or through landfills, and the like. Hence, there is a need for establishing clear, generally horizontal borehole paths in subterranean formations having sloughing or caving characteristics, and the present invention fills that need.

SUMMARY OF THE INVENTION

In accordance with the present invention, a process for establishing a clear, generally horizontal borehole path in a subterranean formation having sloughing or caving characteristics includes the steps of drilling a generally horizontal borehole into a subterranean formation having sloughing or caving characteristics using a drill bit and a drill pipe, and lubricating the drill bit and drill pipe with a mud capable of forming a cake on the borehole walls.

Thereafter, a liner is inserted along the drill pipe and subsequently, the drill pipe is removed from the borehole leaving a linear in the borehole to establish a clear path therethrough.

More particularly, the drill bit and drill pipe is withdrawn from the horizontal borehole with the borehole cake maintaining the borehole wall integrity while the drill pipe is removed from the borehole.

The drill bit is replaced with a casing shoe and thereafter the casing shoe and the drill pipe is inserted into the borehole.

A linear is inserted into the borehole through the drill pipe and thereafter the drill pipe and the casing shoe is removed from the borehole while holding the liner within the borehole. During this operation, the casing shoe passes on the outside of the liner as it is removed. More specifically, the casing shoe, drill pipe and the liner therein are inserted simultaneously into the borehole. In this manner, the drill pipe enables the liner to be inserted within the borehole up to several thousand feet without relying on the strength of the liner.

Periodically, during the simultaneous insertion of the casing shoe drill pipe and liner, the insertion may be intermittently stopped and the borehole flushed with lubricating mud.

Additionally, if obstacles are encountered such as when a partial caving occurs, the drill pipe casing shoe and liner therein may be rotated in order that the casing shoe provide means for cutting through the blockage without damaging the liner inside of the drill pipe. After drilling to clear any obstacles, the borehole may be flushed by pumping lubricating mud down the liner to flush out and move aside any of the cuttings or sloughed wall from the borehole.

During the drilling process, sufficient mud is pumped to not only lubricate the drill pipe and bit, but to carry cuttings, created by the drilling, from the horizontal borehole in the form of an efflux having a total solids content comprising cuttings and mud solids. Additionally, the process includes removing cuttings from the efflux and adjusting the total solids content therein to a preselected level to form a recycled efflux and thereafter pumping the recycled efflux into the horizontal borehole.

When mud solids comprise Bentonite, the total solids content in the recycled efflux is adjusted to a preselected level between about 5 percent by weight and about 25 percent by weight Bentonite. Preferably, the preselected of total solids content is adjusted to below about 10 percent by weight, however, this is dependent upon the type of formation through which the borehole is drilled and is dependent upon the density and porosity of the formation. The efflux is continually monitored to determine the solids contents therein and adjusted so that the recycled efflux remains at predetermined levels. It is necessary to adjust the mud-solids contents of the recycled efflux in order to create sufficient mud cake buildup in and/or on the borehole walls to prevent significant sloughing or caving in when the drill bit and drill pipe are removed from the borehole.

Adjustment of the solids content during the drilling process is continued and adjusted so that the viscosity of the recycled efflux decreases as the horizontal borehole is drilled longer.

Further, a deflocculant may be added to the recycled efflux, such as sodium acid pyrophosphate.

BRIEF DESCRIPTION OF THE DRAWINGS

A better understanding of the present invention may be had from the consideration of the following detailed description, taken in conjunction with the accompanying drawings in which.

DETAILED DESCRIPTION

Figure 1:
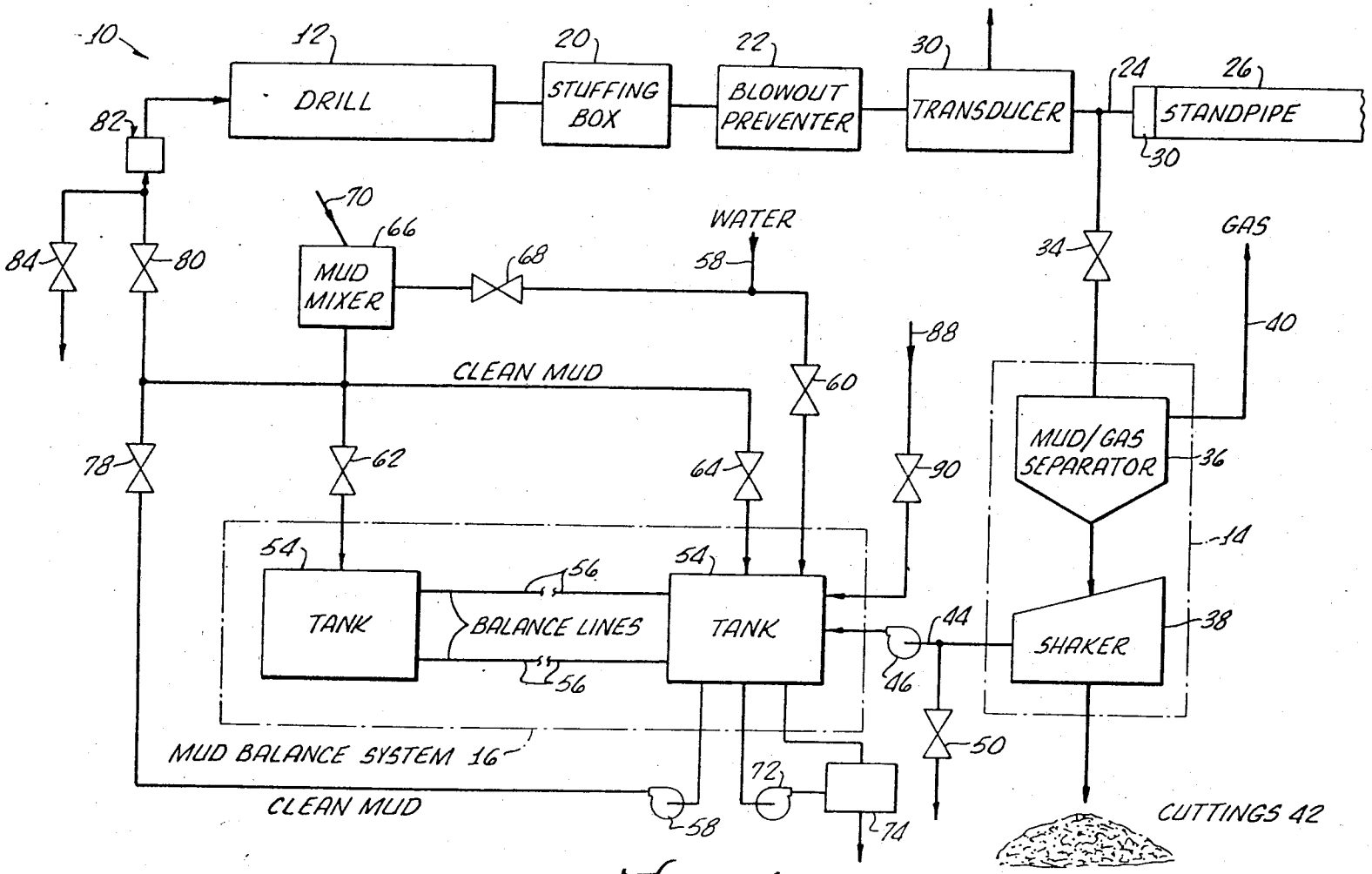
FIG. 1 is a schematic diagram of equipment for performing the process of the present invention, generally showing a drill and associated equipment for forming the borehole cake on and in the wall of the horizontal borehole as it is drilled.

Turning to FIG. 1, there is shown apparatus 10 suitable for performing the process of the present invention which generally includes a drill 12, a separator system 14 and a mud balance system 16.

More particularly, the drill 12 may be of any suitable type for drilling horizontal holes in subterranean formations which is interconnected with a drill bit, not shown, by a drill pipe 24 extending through a conventional stuffing box 20, blowout preventer 22, and standpipe 26.

As schematically shown in FIG. 1, standpipe sensors 30 may be provided for monitoring the pressure of the fluids pumped into and returning from the stand-pipe in order to evaluate the drilling process and provide information with regard to the balance of mud and water in the drilling fluid, which may be later used to adjust the content thereof in recycled slurry as will be hereinafter described in greater detail. The sensors 30 may also be used for survey systems or borehole control.

Efflux from the borehole is conducted through a valve 34 to the separation system 14, with the latter consisting of a conventional mud gas separator 36 and a solid separator, or shaker, 38.

Gas is collected through a vent 40 and cuttings 42 disposed of while the remaining efflux, which may contain fine cuttings, is passed to the mud balance system 16 via a conduit 44 and a pump 46.

It should be appreciated that while a limited number of pumps 46 and 48 are shown in FIG. 1 in diagrammatic form, it is to be appreciated that the number and placement of pumps in the system and other cleaning and monitoring equipment (not shown) may be of any configuration suitable for transporting and cleaning the fluids handled by the system as generally indicated in the diagram of FIG. 1.

A sampling valve 50 may be provided in order to monitor the solids liquid character and content in the efflux provided to the mud balance system 16.

The mud balance system generally consists of a plurality of tanks 54, only two shown in FIG. 1 for the sake of brevity, which are interconnected by balance lines 56 for circulating the efflux therebetween.

Additional water may be added to the mud balance system 16 through an inlet 58 and valve 60 into the tank 54. Accordingly, clean mud, which may be Bentonite, as hereinafter described, may be introduced into the tanks 54 via valves 62, 64 which is obtained via a conventional mud mixer 66 utilizing water, or recycled mud, through a valve 68 and dry mud from an intake 70. A pump 72 may be used to feed mud through a hydroclone 74 in order to clean fine cuttings (not shown) from the mud.

A pump 58 supplies the balanced mud through valves 78, 80 to the drill 12 via a flowmeter 82 with the recycled efflux passing through the drill pipe down into the borehole. A sampling valve 84 may be provided to monitor a solids liquids content of the recycled efflux to ensure that proper mud water balances exist and the viscosity is suitable for the drilling operation.

It has been found that the mud balance system must be adjusted throughout the drilling procedure, particularly as the length of the hole increases. For example, as will be hereinafter described in greater detail, the mud solids content is significantly reduced and the viscosity of the recycled slurry is significantly reduced as the drilling progresses while additional defloculant or anticoagulant additives are included, which are added to the recycled slurry into the mud balance system 16 via an additive inlet 88 and valve 90.

Figure 2:
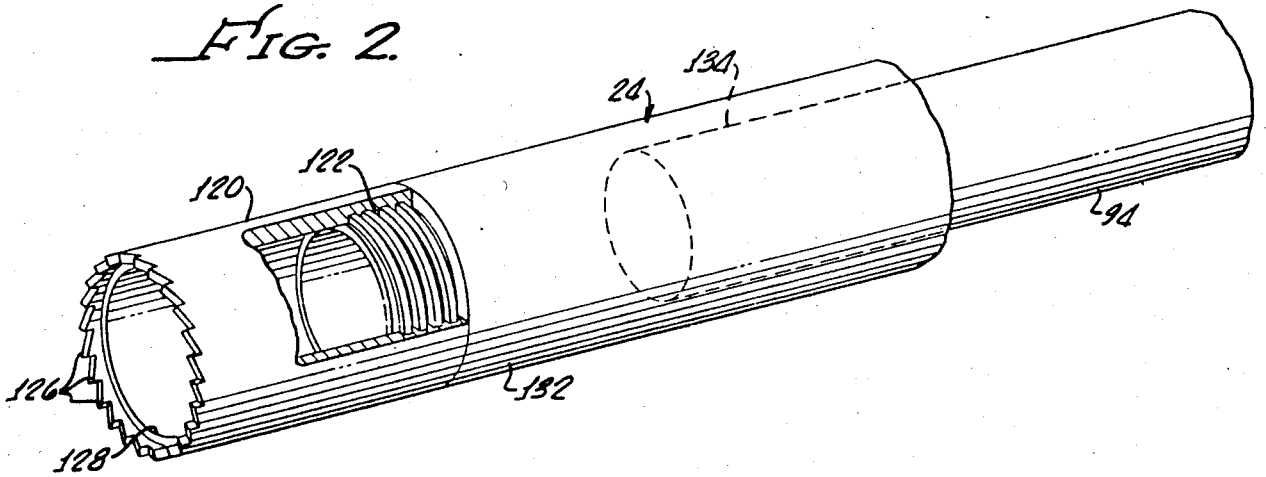
FIG. 2 is a plan view of a liner section for use in the process of the present invention showing a threaded end portions thereon for coupling sections to one another.
Figure 3:
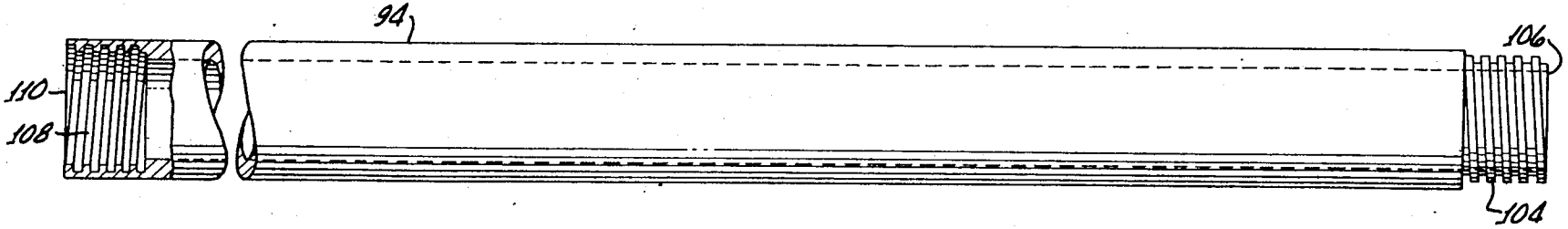
FIG. 3 is a perspective view of a special casing shoe for use with the process of the present invention; and, FIGS. 4*a, b,* and *c* are diagrams representing apparatus and steps for withdrawing drill pipe from a borehole over the liner.

As shown in FIG. 2 and 3, a liner 94 suitable for process of the present invention may be formed of a two inch, or any other suitable size, plastic PVC pipe (such as schedule 80) in order to provide a flush outside surface for the liner which preferably is made in 10 foot sections. External threads 104 formed on one end 106 of each liner section 94 are sized and designed for engaging internal threads 108 on another end 110 of each liner section 94.

Generally, the process of the present invention includes drilling a generally horizontal borehole into a subterranean formation using a drilling and circulating fluid composed of a mixture of fresh water, drill cuttings, and additives, the additives particularly including Bentonite clays.

As is well known, Bentonite is a soft, porous, plastic, light-colored rock composed mainly of clay minerals and silica. It is commercially available from N. L. Baroid, Houston, Tex.

The Bentonite is used as a finely ground powder having a particle size of less than about U.S. mesh 400. When mixed with water, the resultant composition becomes a thixotropic mud.

This thixotropic mud is circulated down the drill string and it serves to clean the hole by flushing cuttings thereout of as well as lubricate the downhole tools and drilling assemblies.

Importantly, the Bentonite thixotropic mud stabilizes the borehole walls by the formation of a mud solids wall cake.

The formation of the mud solids cake on and in the walls of the advancing borehole is caused by a seeping, or leaking, of a certain portion of the water, in the drill fluid, into the formation surrounding the borehole. A formation having sloughing or caving characteristics generally has a high permeability, hence, the water is accepted thereby, but the muds are deposited on and in the pores of the formation.

It is apparent that the flow of drilling fluid into the formation is therefore limited by the pressure differential available in the borehole and the permeability of the solid cake formed by the filtration on the borehole walls.

In the present invention, the initial drilling mud is mixed using about 50 pounds of high-yield Bentonite per 100 gallons of fresh water and thereafter adjusted by addition of water or Bentonite to provide a Marsh funnel time of 70 seconds or more which corresponds to a viscosity of between about 40 cP and about 50 cP.

Initially, a pilot hole is drilled as straight as possible to a depth of about 40 feet horizontally or more as required by the anticipated standpipe 26.

Thereafter, a survey of the pilot hole is taken with a single shot survey instrument to ensure accuracy of the path. The pilot string is withdrawn and replaced with the reamer/hole opener assembly which is then used to open the hole to a size sufficient to insert the standpipe. As is well known in the art, one or more passes may be required depending upon the size of the record standpipe and/or the formation.

The standpipe 26, with required grouting accessories (not shown), is assembled and prepared and the hole is circulated with drilling mud and the reaming assembly is withdrawn.

The standpipe is run to a total depth and pulled back at least one foot to allow connection for the wellhead and grouting clearance of the downhole end of the standpipe. After grouting of the standpipe, the drilling of the borehole is commenced.

During the drilling phase, the return drilling fluid is monitored via valve 50 to determine the proper treatment of the recycled efflux depending upon the circumstances encountered by the drilling. As the drilling advances, the solid drill cuttings are removed from the system, as shown in FIG. 1.

The sampling techniques, as well as the mud gas separator 36 and shaker 38, provide information as to their output with regard to the amount of type of materials being cut by the downhole tools.

Contemporaneously, the fluid being returned by the line 44 to the mud balance system 16 determine the amount and type of solids and additives that are being consumed by the drilling.

A mass balance of the total system is performed to determine the amount of water and Bentonite which are left in the formation of the borehole cake.

It is apparent that the formation of the borehole cake is the most critical item since it is the phenomenon that requires the addition of the Bentonite and additives in order to provide the borehole stability that allows further drilling in the formation and continued circulation in the borehole. It is the loss of borehole stability that requires the fluid handling system as shown in FIG. 1.

Tests to establish the quality and quantity of additives are based on the fluid and drilling response. For example, in the event that the drilling encounters a series of lost circulation zones, or portions of the hole that are not stabilized by the available fluid and/or solids, it is necessary to change the formulation of the drilling fluid. These lost circulation zones are identified by the transducer 30, which indicates the pressure of the drilling fluid in the borehole.

Generally, the basis for changing the fluid makeup is made on the quantity and quality of the return fluid to the mud balance system 16. In normal drilling, the formation can usually be maintained by establishing a minimum required for Bentonite content in the recirculated drilling fluid and a maximum cutting content in the same fluid. This total solids content in the associated ratio of the Bentonite and the cuttings are important to the downhole characteristics of the cake formation, as well as the character of the mud to accept additional Bentonite and still perform its intended use as a hole drilling lubricant and a downhole cleaner.

It has been found generally that the recycled slurry should be adjusted so that the level of Bentonite is between about 5 percent by weight and about 25 percent by weight. Preferably, depending upon the formation being drilled, the total solids contents of cuttings and Bentonite is below about 10 percent by weight.

However, in testing, it has been determined that the maximum practcal limit of 15 percent total solids can be maintained when no additional rheological modifiers, or additives, are used in the recirculated efflux. However, levels as high as 20–25 percent can be used in the solid of the smaller (that is, less than 200 U.S. mesh) with the addition of dispersing agents.

Although dispersing agents may be used to advantage, they are expensive and can cause additional problems with formation damage.

It has been found that for long holes, those over 500 feet, the viscosity of the mud needs to be reduced and, in addition, a defloculant may be added to prevent bridging of the cuttings in the annulus 144 (see FIG. 4) which causes a blockage in fluid circulation.

The amount of Bentonite used per 300 gallons is about 100 pounds and a defloculant, such as sodium acid as pyrophosphate (known commercially as SAPP) and available from N. L. Baroid, may be utilized in the amount of about $\frac{1}{4}$ to $\frac{3}{4}$ of a pound per 100 pounds of Bentonite. This results in a mud having a viscosity of about 10 cP.

Following the completion of the drilling and the formation of the mud cake on the borehole, the drill pipe 24 is withdrawn and a casing shoe 120 (FIG. 3) attached to the drill pipe 24 by means of threads 122, 124 on the casing shoe 120 and drill pipe 24, respectively.

The casing shoe 120 is especially adapted for use with the process of the present invention in that its outside diameter is the same as the outside diameter of the drill pipe 24 and, although it has a set of teeth 126 which project outwardly from the outside diameter of the drill shoe 120 about $\frac{1}{4}$ of an inch, the inside edge 128 is smooth to enable the shoe 120 to be slid over the liner 94 without damage thereto.

The teeth 126, which may be of any suitable type such as carbide, are configured for cutting with a clockwise rotation of the drill pipe.

The process of the present invention enables the relatively weak and flexible plastic liner 94 to be inserted into horizontal holes drilled to lengths of several thousand feet. Because the hole may be slant drilled or undergo sinusoidal turns due to corrections in guiding the drill bit through formations of various hardness, the liner 94 must be guided through turns and, hence, has a tendency to bind if it is simply inserted into the borehole following the drilling thereof. Additionally, sloughing of the wall or caving of the wall during retraction of the drill bit and drill pipe provides obstacles in the borehole past which the liner must be pushed.

Following drilling, the borehole may be flushed with water to remove cuttings and debris from the hole, however, sufficient water is not pumped into the borehole to cause any erosion of the mud cake on the borehole wall.

Following the pulling of the drill bit and drill pipe, the drill bit (not shown) is replaced by the casing shoe 120 and the drill pipe 24 partially inserted into the borehole (not shown).

The liner 94 is inserted into the drill pipe 24 and thereafter the drill pipe and liner inserted into the borehole with a forward portion 132 of the drill pipe 24 inserted into the borehole in advance of a forward portion 134 of the liner. In this manner, the liner forward portion 134 is protected and does not physically contact any cuttings or debris within the borehole or with the borehole wall.

During insertion, if the borehole is obstructed with debris, the drill pipe and the casing shoe along with the liner therein is rotated in order to cause the teeth 126 to clear a pathway for the drill pipe and enclosed liner.

After such rotation, the insertion of the casing shoe, drill pipe and liner is stopped during which time the borehole is flushed with additional lubricating mud to remove any cuttings and debris.

Figure 4A:
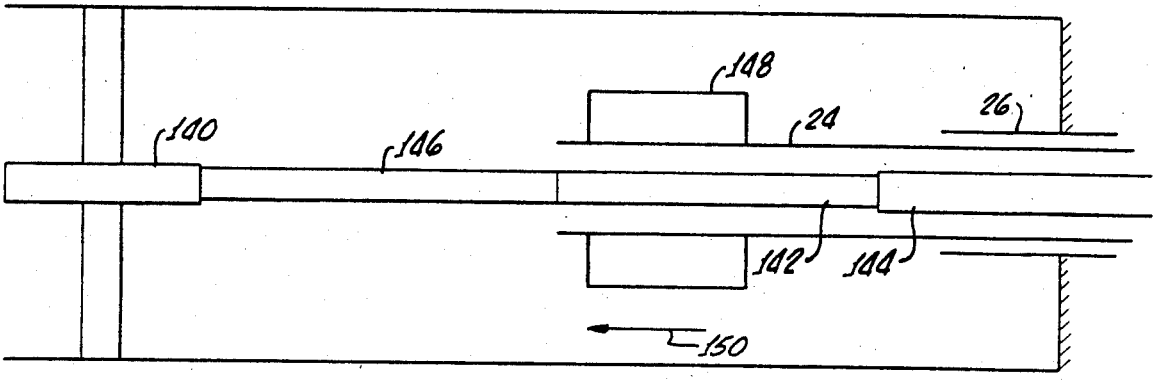

After the liner has been inserted to the desired length, the drill pipe and casing shoe are withdrawn over the liner while the latter is held in place in a procedure shown in FIGS. 4*a, b* and *c*.

Figure 4B:
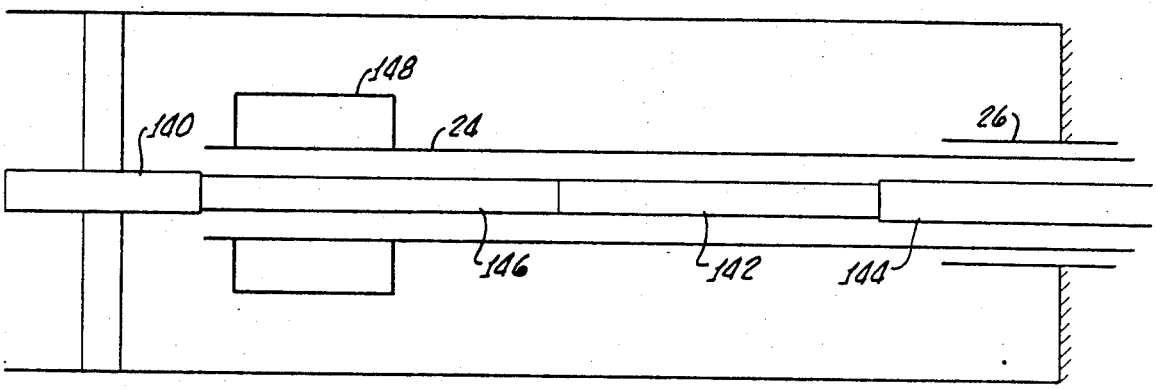
Figure 4C:
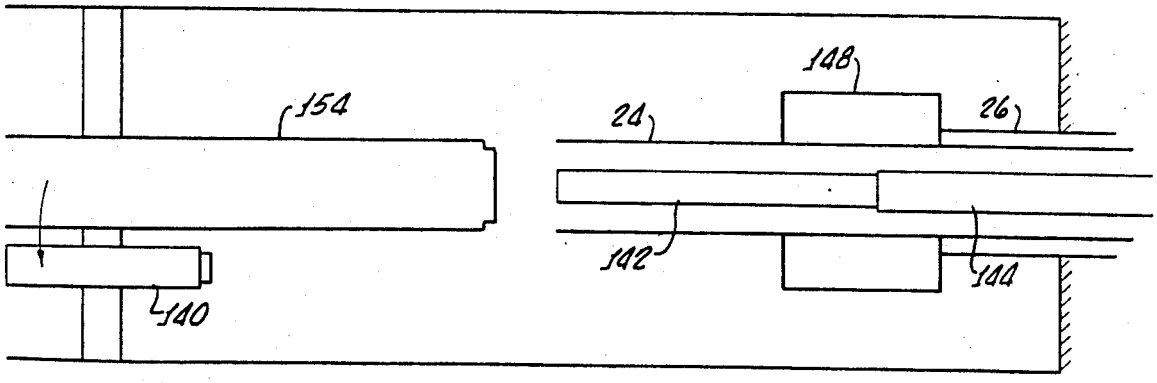

An air cylinder 140 may be rotatably mounted in a conventional manner to enable its alignment with the standpipe 26 as shown in FIG. 4*a* and 4*b* and rotated to a position which is removed from alignment with the standpipe 26 as shown in FIG. 4*c*, the latter position enabling the drill pipe 24 to be uncoupled from one another.

In this procedure, an extension bar 142 is screwed into a last section 144 of plastic liner and abutted by a piston 146 extending from the air cylinder 140 when it is actuated. In this manner, the plastic liner is held into the borehole and standpipe 26 as the drill head 148 is moved in the direction of arrow 150 (FIG. 4*a*) to withdraw the drill pipe 24 from the borehole and standpipe 26 as shown in FIG. 4*b*.

Subsequent to withdrawing a 10 foot section of drill pipe 24, the drill head 148 is moved to a position proximate the standpipe 26 and the piston 146 is withdrawn into the air cylinder 140 which is then rotated to enable a section 154 of drill pipe to be unscrewed and removed from the drill pipe 24. This procedure is repeated until all of the drill pipe 24 is removed from the hole. As this occurs, the drill pipe 24 passes over the liner 94 as does the casing shoe 120. No damage occurs to the relatively soft plastic liner 94 as this process continues because of the smooth interior surface of the drill pipe and the smooth interior edge 128 of the casing shoe 120.

Following the complete removal of drill pipe 24 and casing shoe 120, the inside of the liner 94 may be flushed with water to ensure a clear path therethrough and thereafter the liner 94 may be grouted into the standpipe 26 in a conventional manner.

Although there has been hereinabove described a specific process for establishing a clear, generally horizontal borehole path in a subterranean formation having sloughing or caving characteristics, for the purpose of illustrating the manner in which the present invention may be used to advantage, it should be appreciated that the invention is not limited thereto. Accordingly, any and all modifications, variations or equivalent arrangements, which may occur to those skilled in the art, should be considered to be within the scope of the invention as defined in the appended claims.

What is claimed is:

1. A process for establishing a clear, generally horizontal borehole path in a subterranean formation having sloughing or caving characteristics, said process comprising the steps of:

drilling a generally horizontal borehole into a subterranean formation having sloughing or caving characteristics using a drill bit and drill pipe;

lubricating the drill bit and drill pipe with a mud capable of forming a cake on the borehole walls;

withdrawing the drill bit and drill pipe and thereafter replacing the drill bit with a casing shoe, said cake maintaining borehole wall integrity while the drill pipe is removed from the borehole;

inserting the casing shoe and drill pipe into the borehole;

simultaneously inserting a liner into the generally horizontal borehole inside of the drill pipe; and, removing the drill pipe and casing shoe while holding the liner within the borehole, said casing shoe passing on the outside of said liner as it is removed, said liner providing a clean path through the borehole.

2. The process according to claim 1 wherein the borehole is flushed with lubricating mud as the casing shoe, drill pipe and liner therein are inserted into the borehole.

3. The process according to claim 2 wherein the insertion of the casing shoe, drill pipe and liner therein is stopped during the time the borehole is flushed with lubricating mud.

4. The process according to claim 2 wherein the mud solids comprises a thixotropic mud.

5. The process according to claim 1 wherein the casing shoe and a portion of the drill pipe is inserted in the borehole in advance of the liner.

6. The process according to claim 1 wherein the casing shoe and drill pipe with the liner therein are rotated as the casing shoe, drill pipe and liner therein are inserted into the borehole as necessary to overcome obstructions therein caused by borehole sloughing or caving.

7. The process according to claim 1 wherein the drill bit and drill pipe is lubricated with mud in sufficient quantity to carry cuttings, created by the drilling, from the horizontal borehole in the form of an efflux having a total solids content comprising cuttings and mud solids.

8. The process according to claim 7 further comprising the steps of removing cuttings from the efflux, adjusting the total solids content therein to preselected levels to form a recycled efflux and pumping the recycled efflux into the horizontal borehole.

9. The process according to claim 8 wherein the mud solids comprises Bentonite and the total solids content in the recycled efflux is adjusted to a preselected level of between about 5 percent by weight and about 25 percent by weight Bentonite.

10. The process according to claim 9 wherein the preselected level of total solids is adjusted to below about 10 percent by weight.

11. The process according to claim 8 further comprising the step of monitoring the efflux to determine the solids content therein and adjusting the total solids in the recycled efflux in response to the solids content in the efflux.

12. The process according to claim 8 wherein the mud solids content of the recycled efflux is adjusted to enable sufficient mud cake buildup in and/or on the horizontal borehole walls to prevent significant sloughing or caving in.

13. The process according to claim 12 further comprising the step of adjusting the solids content of the efflux so that the recycled efflux viscosity decreases as the horizontal borehole is drilled longer.

14. The process according to claim 1 wherein the lubricant comprises mud solids, water and a defloculant.

15. The process according to claim 14 wherein the mud solids comprise Bentonite and the defloculant comprises sodium acid pyrophosphate.

16. A process for establishing a clear, generally horizontal borehole path in a subterranean formation having sloughing or caving characteristics, said process comprising the steps of:

drilling a generally horizontal borehole into a subterranean formation having sloughing or caving characteristics using a drill bit and drill pipe with an uphole drilling device;

lubricating the drill bit and drill pipe by pumping a mud down the center of the drill pipe in sufficient quantity to carry cuttings, created by the drilling, from the horizontal borehole in the form of an efflux having a total solids content comprising cuttings and mud solids, said efflux exiting the borehole via an annulus between an outside of the drill pipe and the borehole wall, said mud creating a cake on the borehole wall;

during drilling of the borehole, adjusting the total solids content in the efflux to a preselected level to form a recycled efflux and pumping the recycled efflux, down the center of the drill pipe;

withdrawing the drill bit and drill rod and thereafter replacing the drill bit with a casing shoe, said borehole cake maintaining borehole wall integrity while the drill pipe is removed from the borehole;

inserting the casing shoe and a forward portion of the drill pipe into the borehole; inserting a forward portion of a liner inside the drill pipe with an end of said drill pipe forward portion extending into the borehole farther than a forward end of the liner;

moving the drill pipe into the borehole with the liner therein;

rotating the casing shoe, drill pipe and liner as necessary to push the casing shoe, drill pipe and liner past obstructions in the borehole caused by borehole sloughing or caving;

intermittently stopping the insertion of the casing shoe, drill pipe and liner and flushing the borehole with mud;

at a preselected point of insertion, removing the drill pipe and casing shoe while holding the liner within the borehole, said casing shoe passing on the outside of said liner as it is removed;

flushing the inside of the liner with water to provide a clear path through the borehole.

* * * * *